US009890445B2

(12) United States Patent
Yamashita et al.

(10) Patent No.: US 9,890,445 B2
(45) Date of Patent: Feb. 13, 2018

(54) STEEL FOR MECHANICAL STRUCTURE FOR COLD WORKING, AND METHOD FOR MANUFACTURING SAME

(71) Applicant: Kobe Steel, Ltd., Kobe-shi (JP)

(72) Inventors: Kouji Yamashita, Kobe (JP); Takehiro Tsuchida, Kobe (JP); Masamichi Chiba, Kobe (JP)

(73) Assignee: Kobe Steel, Ltd., Kobe-shi (JP)

( * ) Notice: Subject to any disclaimer, the term of this patent is extended or adjusted under 35 U.S.C. 154(b) by 699 days.

(21) Appl. No.: 14/363,199

(22) PCT Filed: Dec. 11, 2012

(86) PCT No.: PCT/JP2012/082063
§ 371 (c)(1),
(2) Date: Jun. 5, 2014

(87) PCT Pub. No.: WO2013/094475
PCT Pub. Date: Jun. 27, 2013

(65) Prior Publication Data

US 2014/0326369 A1 Nov. 6, 2014

(30) Foreign Application Priority Data

Dec. 19, 2011 (JP) ..... 2011-277683
Mar. 26, 2012 (JP) ..... 2012-070365

(51) Int. Cl.
*C22C 38/48* (2006.01)
*C22C 38/50* (2006.01)
(Continued)

(52) U.S. Cl.
CPC ..... *C22C 38/22* (2013.01); *C21D 1/32* (2013.01); *C21D 8/0226* (2013.01); *C21D 8/06* (2013.01);
(Continued)

(58) Field of Classification Search
CPC ..... C21D 1/32; C21D 2211/003; C21D 2211/005; C21D 2211/009
See application file for complete search history.

(56) References Cited

U.S. PATENT DOCUMENTS 6,475,306 B1 * 11/2002 Kanisawa ..... C21D 8/06 148/320

FOREIGN PATENT DOCUMENTS

JP 11-12684 1/1999
JP 2000-119809 4/2000
(Continued)

OTHER PUBLICATIONS

"Glossary of Metallurgical and Metalworking Terms," Metals Handbook, ASM Handbooks Online, ASM International, 2002, pp. 1, 94, 170, 257.*
(Continued)

*Primary Examiner* — Scott Kastler
*Assistant Examiner* — Vanessa T Luk
(74) *Attorney, Agent, or Firm* — Oblon, McClelland, Maier & Neustadt, L.L.P.

(57) ABSTRACT

Provided are a steel for a mechanical structure for cold working, and a method for manufacturing the same, whereby softening and variations in hardness can be reduced even when a conventional spheroidizing annealing process is performed. A steel having a predetermined chemical composition, the total area ratio of pearlite and pro-eutectoid ferrite being at least 90 area % with respect to the total metallographic structure of the steel, the area ratio (A) of pro-eutectoid ferrite satisfying the relationship A>Ae with an Ae value expressed by a predetermined relational expression, the average equivalent circular diameter of bcc-Fe crystal grains being 15-35 μm, and the average of the maximum grain diameter and the second largest grain diam-
(Continued)

eter of the bcc-Fe crystal grains being 50 μm or less in terms of equivalent circular diameter.

14 Claims, 1 Drawing Sheet

(51) Int. Cl.

| | |
|---|---|
| ***C21D 1/32*** | (2006.01) |
| ***C21D 8/02*** | (2006.01) |
| ***C22C 38/22*** | (2006.01) |
| ***C21D 8/06*** | (2006.01) |
| ***C22C 38/06*** | (2006.01) |
| ***C22C 38/00*** | (2006.01) |
| ***C22C 38/02*** | (2006.01) |
| ***C22C 38/04*** | (2006.01) |
| ***C22C 38/08*** | (2006.01) |
| ***C22C 38/12*** | (2006.01) |
| ***C22C 38/14*** | (2006.01) |
| ***C22C 38/16*** | (2006.01) |
| ***C22C 38/18*** | (2006.01) |
| *C21D 8/00* | (2006.01) |

(52) U.S. Cl.

CPC ..... *C21D 8/065* (2013.01); *C22C 38/001* (2013.01); *C22C 38/002* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C22C 38/18* (2013.01); *C22C 38/48* (2013.01); *C22C 38/50* (2013.01); *C21D 8/005* (2013.01); *C21D 2211/005* (2013.01); *C21D 2211/009* (2013.01)

(56) References Cited

FOREIGN PATENT DOCUMENTS

| | | | |
|---|---|---|---|
| JP | 2009-275252 | | 11/2009 |
| JP | 2009275252 A | * | 11/2009 |
| JP | 2010-159476 | | 7/2010 |
| JP | 2010-236005 | | 10/2010 |
| JP | 2013-7088 | | 1/2013 |
| JP | 2013-7090 | | 1/2013 |
| TW | 200632108 | | 9/2006 |

OTHER PUBLICATIONS

R. E. Napolitano, Measurement of ASTM Grain Size Number, 6 pages, publication date unknown.*

International Search Report dated Feb. 26, 2013, in PCT/JP12/082063 filed Dec. 11, 2012.

Written Opinion of the International Searching Authority dated Feb. 26, 2013, in PCT/JP12/082063 filed Dec. 11, 2012.

* cited by examiner

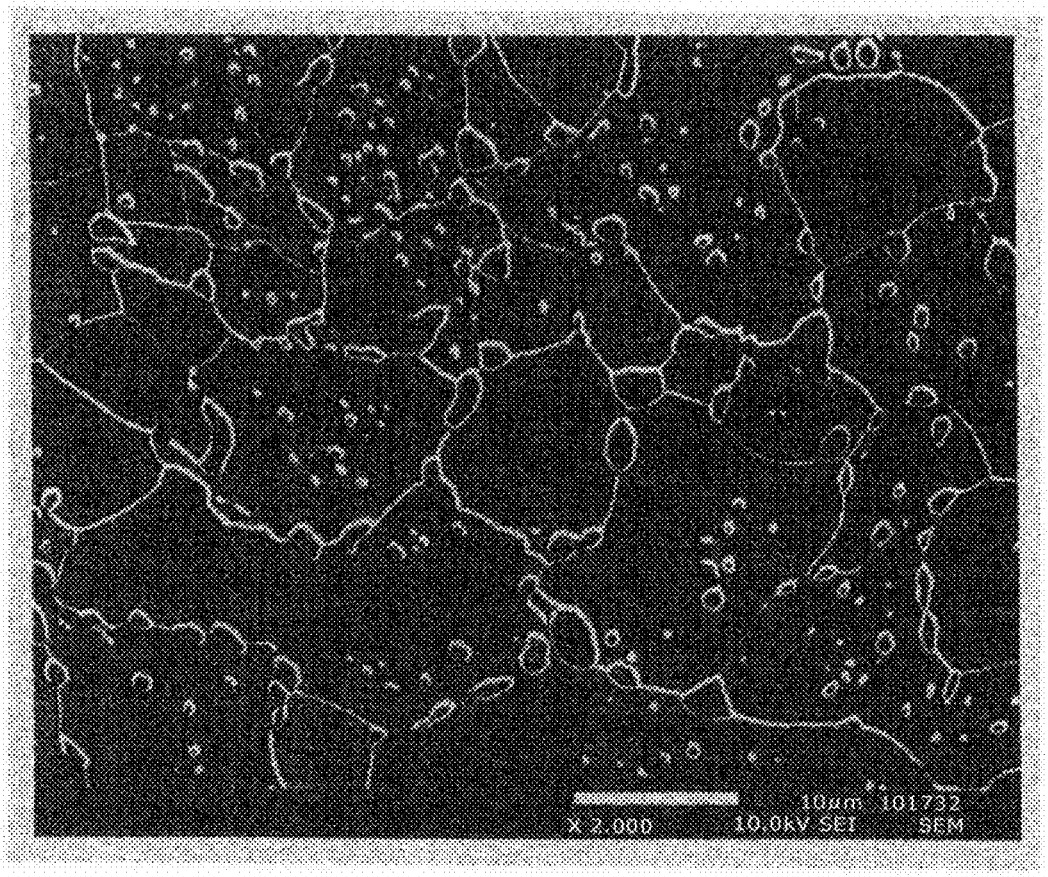
10μm 101732
X 2,000 10.0kV SEI SEM

STEEL FOR MECHANICAL STRUCTURE FOR COLD WORKING, AND METHOD FOR MANUFACTURING SAME

TECHNICAL FIELD

The present invention relates to a steel for mechanical structure for cold working, which is used to produce various components, such as components for automobiles, or components for construction machines. The invention relates particularly to a steel low in deformation resistance after being spheroidized, so as to be excellent in cold workability; and a method useful for manufacturing such a steel for mechanical structure for cold working. Specifically, a subject of the invention is a wire rod or steel bar, for a high-strength mechanical structure, that is used for, for example, a mechanical component or transmission component produced by cold forging, cold heading, cold gear rolling or any other cold working, such as a bolt, screw, nut, socket, ball joint, inner tube, torsion bar, clutch case, cage, housing, hub, cover, case, washer, tappet, saddle, bulk, inner case, clutch, sleeve, outer race, sprocket, core, stator, anvil, spider, rocker arm, body, flange, drum, joint, connector, pulley, metal fitting, yoke, mouth piece, valve lifter, spark plug, pinion gear, steering shaft, or common-rail. The steel of the invention produces the following advantages when components for various mechanical structures as described above are each produced: the steel is low in deformation resistance at room temperature and in its region which is worked to generate heat; and further restrains cracking of the steel itself or cracking of the mold concerned. As a result, the steel can exhibit an excellent cold workability.

BACKGROUND ART

At the time of producing various components, such as components for automobiles or components for construction machines, a process is performed which involves: subjecting a hot-rolled material of carbon steel, alloy steel or the like to spheroidizing treatment to give cold workability thereto; cold-working the material; subjecting the material to cutting or some other working to be formed into a predetermined shape; and then subjecting the material to quenching and tempering to adjust the final strength of the material.

In recent years, the shape of components has tended to be made complicated and large. With the tendency, steel material has been required to be made still softer in a cold working step, thereby preventing the steel material from being cracked and improving the lifespan of the mold (concerned). In order to be made still softer, the steel material is subjected to spheroidizing treatment for a longer period. However, to make the period for the thermal treatment too long causes a problem from the viewpoint of energy saving.

Hitherto, several methods have been suggested for obtaining a softness equivalent to that of ordinary spheroidized material even when the period for spheroidizing is made short or the spheroidizing period is omitted. As such a technique, Patent Literature 1 discloses a technique of specifying pro-eutectoid ferrite- and pearlite-microstructures, adjusting the average grain diameter thereof into the range of 6 to 15 μm, and further specifying the volume proportion of ferrite, thereby making a rapid attainment of spheroidizing treatment compatible with the cold forgeability of the steel. When the microstructure is made fine, the spheroidizing treatment period can be shortened; however, when a material is subjected to an ordinary spheroidizing treatment (annealing treatment for about 10 to 30 hours), the material is insufficiently softened.

Patent Literature 2 discloses a technique of specifying not only the volume proportion of pro-eutectoid ferrite but also the respective volume proportions of pearlite-microstructure and bainite-microstructure, thereby making it possible to shorten the period for annealing. According to such a technique, the steel attains a rapid spheroidization; however, the steel is not yet sufficiently softened. Additionally, the steel is made into a mixed microstructure of bainite and pearlite, so that it is feared that the steel becomes uneven in hardness after being spheroidized.

CITATION LIST

Patent Literatures

[PTL 1] JP 2000-119809 A
[PTL 2] JP 2009-275252 A

SUMMARY OF INVENTION

Technical Problem

The present invention has been made under such a situation. An object thereof is to provide a steel for mechanical structure for cold working which can be made soft by the spheroidizing of the steel even when the spheroidizing is an ordinary spheroidizing, and further which can be decreased in unevenness of hardness; and a method useful for manufacturing such a steel for mechanical structure for cold working.

Solution to Problem

The subject matter of the steel of the present invention, for mechanical structure for cold working, which can attain the object, is a steel comprising: C: 0.3 to 0.6% ("%" means "% by mass"; the same applies to any of the following chemical components), Si: 0.005 to 0.5%, Mn: 0.2 to 1.5%, P: 0.03% or less by mass (the expression not including 0%), S: 0.03% or less by mass (the expression not including 0%), Al: 0.01 to 0.1%, and N: 0.015% or less by mass (the expression not including 0%) with the remainder consisting of iron and inevitable impurities, the steel having a metallic microstructure having pearlite and pro-eutectoid ferrite, wherein: the total area proportion of pearlite and pro-eutectoid ferrite in the entire microstructure of the steel is 90% or more by area; the area proportion A of pro-eutectoid ferrite satisfies A>Ae about a relation between the proportion A and a value Ae represented by the following equation (1):

$$Ae=(0.8-Ceq_1)\times 96.75 \quad (1)$$

wherein $Ceq_1$=[C]+0.1×[Si]+0.06×[Mn] wherein [C], [Si] and [Mn] represent the respective contents by percentage (%) of C, Si and Mn; bcc-Fe crystal grains each surrounded by a high angle grain boundary through which two crystal grains are adjacent to each other at a misorientation larger than 15° have an average circular equivalent diameter of 15 to 35 μm; and the average of the largest grain diameter of the bcc-Fe crystal grains and the second largest grain diameter thereof is 50 μm or less in terms of the respective circular equivalent diameters of the grains. The wording "circular equivalent diameter" is the diameter (circular equivalent diameter) obtained when a bcc-Fe crystal grain surrounded by a high angle grain boundary about which the above-specified misorientation is larger than 15° is converted into a circle having the same area. The wording "average circular equivalent diameter" is the average of the respective diameters of such grains. The average of the largest grain diameter of the bcc-Fe crystal grains and the second largest grain diameter thereof in terms of the respective circular equivalent diameters of the grains may be referred to as the "coarse portion grain diameter" for the convenience of description hereinafter.

The basic chemical components of the steel of the present invention for mechanical structure for cold working have been as described above. It is also useful to incorporate, for example, the following thereinto if necessary: (a) one or more selected from the group consisting of Cr: 0.5% or less by mass (the expression not including 0%), Cu: 0.25% or less by mass (the expression not including 0%), Ni: 0.25% or less by mass (the expression not including 0%), Mo: 0.25% or less by mass (the expression not including 0%), and B: 0.01% or less by mass (the expression not including 0%); and (b) one or more selected from the group consisting of: Ti: 0.2% or less by mass (the expression not including 0%), Nb: 0.2% or less by mass (the expression not including 0%), and V: 0.5% or less by mass (the expression not including 0%). In accordance with one or more of the incorporated components, the property of the steel is further improved.

At the time of manufacturing the above-mentioned steel of the present invention for mechanical structure for cold working, it is advisable that a method therefor includes the following steps in a step-described order: the step of subjecting a working steel for the steel to finish rolling at a temperature higher than 950° C. and 1100° C. or lower, the step of cooling the resultant steel to a temperature in the range of 700° C. or higher and lower than 800° C. at an average cooling rate of 10° C./second or more, and the step of cooling the resultant steel at an average cooling rate of 0.2° C./second or less for 100 seconds or more.

The steel of the present invention for mechanical structure for cold working may also be manufactured by a method including the following steps in a step-described order: the step of subjecting a working steel for the steel to finish rolling at a temperature of 1050° C. or higher and 1200° C. or lower, the step of cooling the resultant steel to a temperature in the range of 700° C. or higher and lower than 800° C. at an average cooling rate of 10° C./second or more, the step of cooling the resultant steel at an average cooling rate of 0.2° C./second or less for 100 seconds or more, the step of cooling the resultant steel to a temperature ranging from 580 to 660° C. at an average cooling rate of 10° C./second or more, and the step of cooling or keeping the resultant steel at an average cooling rate of 1° C./second or less for 20 seconds or more.

The steel of the present invention for mechanical structure for cold working may also be a steel comprising a chemical component composition as described above, and having a metallic microstructure wherein the average circular equivalent diameter of bcc-Fee crystal grains is from 15 to 35 μm, cementite inside the bcc-Fe crystal grains has an aspect ratio of 2.5 or less, and further a K value represented by the following equation (2) is $1.3\times10^{-2}$ or less:

$$K\text{ value}=(N\times L)/E \quad (2)$$

wherein E: the average circular equivalent diameter (μm) of the bcc-Fe crystal grains; N: the number density (/$\mu m^2$) of cementite inside the bcc-Fe crystal grains; and L: the aspect ratio of cementite inside the bcc-Fe crystal grains. This steel for mechanical structure for cold working is assumed to be a steel that has been spheroidized.

Advantageous Effects of Invention

In the present invention, its chemical component composition and further the total area proportion of pearlite and pro-eutectoid ferrite in its entire microstructure are specified, and the area proportion A of pro-eutectoid ferrite is caused to satisfy, about a relationship with the value Ae represented by the predetermined relational expression, A>Ae. Additionally, the average circular equivalent diameter of the bcc-Fe crystal grains and the coarse grain diameter thereof are appropriately specified. These manners make it possible to realize a steel for mechanical structure for cold working which can be made sufficiently low in hardness even when the steel is subjected to an ordinary spheroidizing, and which can further be decreased in unevenness of hardness.

BRIEF DESCRIPTION OF DRAWING

FIG. 1 is an electron microscopic photograph showing an example of a spheroidized microstructure instead of a drawing thereof.

DESCRIPTION OF EMBODIMENTS

The inventors have made investigations from various viewpoints to realize a steel for mechanical structure for cold working which can be made soft by the spheroidizing of the steel even when the spheroidizing is an ordinary spheroidizing, and further which can be decreased in unevenness of hardness. As a result, the inventors have gained an idea that it is important, for making a steel soft after the steel is spheroidized, to make the grain diameter of ferrite crystal grains relatively large through/after the spheroidizing and is important, for decreasing the dispersion strengthening of the steel that is based on spherical cementite, to make the distance between grains of cementite as large as possible. In order to realize a microstructure as described above through/after the spheroidizing, the metallic microstructure before the spheroidizing (hereinafter referred to also as the "pre-microstructure") is caused to have a main phase composed of pearlite and pro-eutectoid ferrite, the area proportion of pro-eutectoid ferrite in the microstructure is made as high as possible, and further the average circular equivalent diameter of bcc-Fe crystal grains (specifically, crystal grains of pro-eutectoid ferrite, and ferrite crystal grains in pearlite) each surrounded by a high angle grain boundary is made relatively large. The inventors have found out that these manners make it possible to lower the steel in hardness at a maximum level through/after the spheroidizing. The inventors have found out that in order to decrease the steel in unevenness of hardness, the coarse portion grain diameter of the bcc-Fe crystal grains is adjusted to 50 μm or less. In this way, the present invention has been accomplished.

Through/after the spheroidizing, the microstructure of the steel is changed to a microstructure made mainly of cementite (spherical cementite) and ferrite. Cementite and ferrite are each a metallic phase causing a decrease in the deformation resistance of the steel to contribute to an improvement thereof in cold workability. However, only by making the steel into a metallic microstructure containing spherical cementite and ferrite, the steel cannot gain a desired softness. Accordingly, as will be detailed hereinafter, it is necessary to appropriately control the area proportion of this metallic microstructure, the area proportion A of pro-eutectoid ferrite, the average circular equivalent diameter of the bcc-Fe crystal grains, and others.

In a case where the microstructure (pre-microstructure) contains a fine phases, such as bainite or martensite, the microstructure is made fine by effect of bainite or martensite after being subjected to spheroidizing even when the spheroidizing is an ordinary spheroidizing. Thus, the steel is not made sufficiently soft. From such a viewpoint, it is necessary to adjust the total area proportion of pearlite and pro-eutectoid ferrite in the entire microstructure to 90% or more by area. The total area proportion is preferably 95% or more by area, more preferably 97% or more by area. The steel may partially contain, for example, martensite and/or bainite, which can be produced by a process for the production, as a metallic microstructure besides pearlite and pro-eutectoid ferrite. However, if the area proportion of these phases becomes high, the steel may be heightened in strength to be deteriorated in cold workability. Thus, the steel may not contain these phases at all. Thus, the total area proportion of pearlite and pro-eutectoid ferrite in the entire microstructure is most preferably 100% by area.

As is evident from the above, it is necessary to make the area proportion A of pro-eutectoid ferrite as large as possible in the pre-microstructure. By making the area proportion A of pro-eutectoid ferrite large, the steel is made, after being spheroidized, into a state in which pearlite is localized so that spherical cementite grows easily (the distance between grains thereof easily becomes large). The inventors have made investigations from the viewpoint of precipitating pro-eutectoid ferrite up to an equilibrium quantity thereof; and then gained, on basis of experiments, a result that the equilibrium pro-eutectoid ferrite precipitation quantity is represented by $(0.8-Ceq_1)\times 129$, and an idea that the area proportion A of pro-eutectoid ferrite is sufficient when this proportion can certainly keep 75% or more of the equilibrium precipitation quantity. On the basis of the result and idea, the value Ae represented by the following equation (1) has been determined as the minimum necessary pro-eutectoid ferrite quantity that needs to be ensured:

$$Ae=(0.8-Ceq_1)\times 96.75 \quad (1)$$

wherein $Ceq_1=[C]+0.1\times[Si]+0.06\times[Mn]$ wherein [C], [Si] and [Mn] represent the respective contents by percentage (% by mass) of C, Si and Mn. When the area proportion A of pro-eutectoid ferrite is measured, ferrite contained in the pearlite-microstructure should not be involved in the measurement (the measurement is made only for "pro-eutectoid ferrite"). The area proportion of pro-eutectoid ferrite, which is varied in accordance with the component-system thereof, is at most about 65% in the chemical component composition usable in the present invention.

In other words, when the area proportion A of pro-eutectoid ferrite is caused to satisfy, about the relation with the value Ae represented by the equation (1), A>Ae, an advantageous effect based on making the area proportion of pro-eutectoid ferrite large comes to be exhibited. On the contrary, if the area proportion A of pro-eutectoid ferrite is the Ae value or less (i.e., A≤Ae), fine ferrite easily precipitates newly through/after the spheroidizing, so that the steel is not sufficiently softened. If the average circular equivalent diameter of the bcc-Fe crystal grains is made large in the state that the area proportion A of pro-eutectoid ferrite is small, regenerated pearlite is easily produced so that the steel is not easily softened.

When the average circular equivalent diameter of bcc (body-centered cubic lattice)-Fe crystal grains surrounded by a high angle grain boundary (hereinafter referred to as the "average grain diameter of the bcc-Fe crystal grains") in the pre-microstructure is adjusted to 15 μm or more, the steel can be softened through/after the spheroidizing thereof. However, if the average grain diameter of the bcc-Fe crystal grains becomes too large in the pre-microstructure, the steel comes to have a phase for increasing the steel in strength, such as regenerated pearlite, by an ordinary spheroidizing so that the steel is not easily softened. It is therefore necessary to adjust the average grain diameter of the bcc-Fe crystal grains to 35 μm or less. The average grain diameter of the bcc-Fe crystal grains is preferably 18 μm or more, more preferably 20 μm or more. The average grain diameter of the bcc-Fe crystal grains is preferably 32 μm or less, more preferably 30 μm or less.

About ferrite when a measurement is made about the average grain diameter of the bcc-Fe crystal grains, a target (of the measurement) is bcc-Fe crystal grains each surrounded by a high angle grain boundary through which two crystal grains are adjacent to each other at a misorientation larger than 15°. This is because any small angle grain boundary, about which the misorientation is 15° or less, is not largely affected by the spheroidizing. In other words, the bcc-Fe crystal grains each surrounded by the high angle grain boundary, about which the misorientation is larger than 15°, are each converted to a circle having the same area, and the diameter of the circle is set into the above-mentioned range, whereby the steel can be sufficiently softened through/after the spheroidizing. The "misorientation" may be also called the "deviation angle" or "oblique angle". For measuring the misorientation, it is advisable to adopt an EBSP method (electron backscattering pattern method). The bcc-Fe crystal grains the average grain diameter of each of which is measured contains crystal grains of pro-eutectoid ferrite and ferrite contained in the pearlite-microstructure (the latter ferrite is distinguished from "pro-eutectoid ferrite"). From such a viewpoint, the bcc-Fe crystal grains, the average grain diameter of each of which is measured, are different in conception from "pro-eutectoid ferrite".

The average grain diameter of the bcc-Fe crystal grains may affect the generation of not only the regenerated pearlite but also the remaining pearlite. Thus, by controlling the average grain diameter of the bcc-Fe crystal grains, the whole of the material can be averagely softened. However, if sites having coarse grains are locally present in the pre-microstructure, remarkably hard portions are unfavorably generated through/after the spheroidizing. The generation of the remaining pearlite localized and the regenerated pearlite is restrained by setting the average of the respective circular equivalent diameters of the following two to 50 μm or less: a crystal grain having the largest circular equivalent diameter out of the above-mentioned bcc-Fe crystal grains, which are each surrounded by the high angle grain boundary, in the pre-microstructure; and a crystal grain having the second largest circular equivalent diameter out of them (the average will be referred to as the coarse portion grain diameter of the bcc-Fe crystal grains). As a result, the steel can be restrained in unevenness of hardness. The coarse portion grain diameter of the bcc-Fe crystal grains is preferably 45 μM or less, more preferably 40 μm or less.

The present invention has been made on the supposition of being applied to any steel for mechanical structure for cold working. The species of the steel may be any species having an ordinary chemical component composition for a steel for mechanical structure for cold working. About C, Si, Mn, P, S, Al, and N, preferably, the respective quantities thereof should be appropriately adjusted. From such a viewpoint, respective appropriate ranges of these chemical components, and reasons for limitation into the ranges are as follows:

[C: 0.3-0.6%]

C is an element useful for ensuring the strength of the steel (the strength of a final product therefrom). In order to cause the steel to exhibit such an advantageous effect efficiently, the C content by percentage needs to be 0.3% or more. The C content is preferably 0.32% (more preferably 0.34% or more). However, if the C content is too large, the steel is heightened in strength to be lowered in cold workability. Thus, the C content needs to be set to 0.6% or less. The C content is preferably 0.55% or less (more preferably 0.50% or less).

[Si: 0.005-0.5%]

Si is incorporated, as a deoxidizing agent, to increase the strength of the final product by solid solution hardening. However, if the Si content by percentage is less than 0.005%, such an advantageous effect is not effectively exhibited. If Si is excessively incorporated in a proportion more than 0.5%, the steel is excessively raised in hardness to be deteriorated in cold workability. The Si content is preferably 0.007% or more (preferably 0.010% or more), and is preferably 0.45% or less (preferably 0.40% or less).

[Mn: 0.2-1.5%]

Mn is an element for improving the steel in quenchability to increase the final product in strength. However, if the Mn content by percentage is less than 0.2%, the advantageous effect is insufficient. If Mn is excessively incorporated in a proportion more than 1.5%, the steel is heightened in hardness to be deteriorated in cold workability. Thus, the Mn content is set into 0.2-1.5%. The Mn content is preferably 0.3% or more (more preferably 0.4% or more), and is preferably 1.1% or less (more preferably 0.9% or less).

P: 0.03% or Less (the Expression not Including 0%)

P is an element contained inevitably in the steel, and undergoes grain boundary segregation in the steel to deteriorate the steel in ductility. Thus, the P content by percentage is controlled to 0.03% or less. The P content is preferably 0.028% or less (more preferably 0.025% or less).

[S: 0.03% or Less (the Expression not Including 0%)]

S is an element contained inevitably in the steel, and is present in the form of MnS to be a harmful element that deteriorates the steel in ductility for cold working. The S content by percentage needs to be 0.03% or less. The S content is preferably 0.028% or less (more preferably 0.025% or less).

[Al: 0.01-0.1%]

Al is useful as a deoxidizing agent, and further useful for causing N present in the steel and dissolved in a solid solution form to be fixed as AlN. In order to cause Al to exhibit such an advantageous effect, the Al content by percentage needs to be 0.01% or more. However, if the Al content is excessive to be more than 0.1%, $Al_2O_3$ is excessively produced to deteriorate the steel in cold workability. The Al content is preferably 0.013% or more (more preferably 0.015% or more), and is preferably 0.090% or less (more preferably 0.080% or less).

[N: 0.015% or Less (the Expression not Including 0%)]

N is an element contained inevitably in the steel. If N is contained in a solid solution form in the steel, N raises the hardness by strain ageing, and lowers the ductility to deteriorate the cold workability. Thus, the N content by percentage needs to be controlled to 0.015% or less. The N content is preferably 0.013% or less, more preferably 0.010% or less.

A basic chemical component composition of the steel of the present invention for mechanical structure for cold working is as described above. The remainder thereof consists substantially of iron. The wording "consists substantially of iron" means that the steel may contain trace elements (such as Sb and Zn) besides iron as far as the trace elements do not damage the property of the steel of the invention, and may further contain inevitable impurities (such as O and H) other than P, S and N.

It is also useful to incorporate, for example, the following into the steel of the present invention for mechanical structure for cold working if necessary: (a) one or more selected from the group consisting of Cr: 0.5% or less (the expression not including 0%), Cu: 0.25% or less (the expression not including 0%), Ni: 0.25% or less (the expression not including 0%), Mo: 0.25% or less (the expression not including 0%), and B: 0.01% or less (the expression not including 0%); and (b) one or more selected from the group consisting of: Ti: 0.2% or less (the expression not including 0%), Nb: 0.2% or less (the expression not including 0%), and V: 0.5% or less (the expression not including 0%). In accordance with one or more of the incorporated components, the property of the steel is further improved. When these components are incorporated, reasons why the proportion-ranges of the components are restrained are as follows:

[One or More Selected from the Group Consisting of Cr: 0.5% or Less (the Expression not Including 0%), Cu: 0.25% or Less (the Expression not Including 0%), Ni: 0.25% or Less (the Expression not Including 0%), Mo: 0.25% or Less (the Expression not Including 0%), and B: 0.01% or Less (the Expression not Including 0%)]

Cr, Cu, Ni, Mo and B are each an element useful for improving the steel in quenchability to increase the final product in strength. As the need arises, one or more thereof are incorporated into the steel. However, if the content by percentage of each of these elements is excessive, the steel becomes too high in strength and is deteriorated in cold workability. Thus, a preferred upper limit of the content of each of the elements is specified as described above. More preferably, the content of Cr is 0.45% or less (even more preferably 0.40% or less), that of each of Cu, Ni and Mo is 0.22% or less (even more preferably 0.20% or less), and that of B is 0.007% or less (even more preferably 0.005% or less). As the respective contents of these elements are made larger, the respective advantageous effects thereof become larger. However, in order to cause the elements to exhibit the advantageous effects effectively, preferably, the content of Cr is 0.015% or more (more preferably 0.020% or more), that of each of Cu, Ni and Mo is 0.02% or more (more preferably 0.05% or more), and that of B is 0.0003% or more (more preferably 0.0005% or more).

[One or More Selected from the Group Consisting of Ti: 0.2% or Less (the Expression not Including 0%), Nb: 0.2% or Less (the Expression not Including 0%), and V: 0.5% or Less (the Expression not Including 0%)]

Ti, Nb and V are each bonded to N to form a compound to decrease N in a solid solution form, thereby producing an advantageous effect of decreasing the steel in deformation resistance. Thus, as the need arises, one or more thereof may be incorporated thereinto. However, if the content by percentage of each of these elements is excessive, the formed compound is raised in deformation resistance so that the steel is conversely lowered in cold workability. Thus, preferably, the content of each of Ti and Nb is 0.2% or less, and that of V is 0.5% or less. More preferably, the content of each of Ti and Nb is 0.18% or less (even more preferably 0.15% or less), and that of V is 0.45% or less (even more preferably 0.40% or less). As the respective contents of these elements are made larger, the respective advantageous effects thereof become larger. However, in order to cause the elements to exhibit the advantageous effects effectively, preferably, the content of each of Ti and Nb is 0.03% or more (more preferably 0.05% or more), and that of V is 0.03% or more (more preferably 0.05% or more).

At the time of manufacturing the above-mentioned steel of the present invention for mechanical structure for cold working, it is advisable to: subject a steel satisfying a component composition as described above to finish rolling at a temperature higher than 950° C. and 1100° C. or lower; subsequently cooling the resultant steel to a temperature in the range of 700° C. or higher and lower than 800° C. at an average cooling rate of 10° C./second or more; and then cool the resultant steel at an average cooling rate of 0.2° C./second or less for 100 seconds or more (this method will be referred to as the "manufacturing method 1"). It is allowable in another method to: subject a steel satisfying a component composition as described above to finish rolling at a temperature of 1050° C. or higher and 1200° C. or lower; subsequently cool the resultant steel once to a temperature in the range of 700° C. or higher and lower than 800° C. at an average cooling rate of 10° C./second or more; subsequently cool the resultant steel at an average cooling rate of 0.2° C./second or less for 100 seconds or more; cool the resultant steel to a temperature ranging from 580 to 660° C. at an average cooling rate of 10° C./second or more; and further cool or keep the resultant steel at an average cooling rate of 1° C./second or less for 20 seconds or more (this method will be referred to as the "manufacturing method 2). A description will be made about respective manufacturing conditions in these manufacturing methods.

Manufacturing Method 1:

In order to control the average grain diameter of the bcc-Fe crystal grains surrounded by the high angle grain boundary into 15-35 μm, it is necessary to control the finish rolling temperature appropriately. If this finish rolling temperature is higher than 1100° C., it is difficult to adjust the average grain diameter to 35 μm or less. If this finish rolling temperature is higher than 1100° C., the coarse portion grain diameter of the bcc-Fe crystal grains also exceeds 50 μm easily. However, if the finish rolling temperature is 950° C. or lower, it is difficult to adjust the average grain diameter of the bcc-Fe crystal grains to 15 μm or more. Thus, the temperature needs to be made higher than 950° C.

If after the finish rolling at the above-mentioned temperature the cooling rate down to a temperature in the range of 700° C. or higher and lower than 800° C. is low, the bcc-Fe crystal grains are made coarse so that the average grain diameter may become more than 35 μm. Additionally, the coarse portion grain diameter of the bcc-Fe crystal grains easily exceeds 50 μm. Thus, the average cooling rate needs to be 10° C./second or more. This average cooling rate is preferably 20° C./second or more, more preferably 30° C./second or more. The upper limit of the average cooling rate at this time is not particularly limited. A realistic range thereof is 200° C./second or less. The cooling at this time may be in such a cooling form that the cooling rate is varied as long as the average cooling rate is 10° C./second or more. At this time, the cooling stop temperature is preferably 710° C. or higher (preferably, 720° C. or higher), and 780° C. or lower (preferably, lower than 750° C.).

After a cooling as described above (i.e., a cooling down to a temperature in the range of 700° C. or higher and lower than 800° C. at an average cooling rate of 10° C./second or more), the workpiece is cooled from the temperature at an average cooling rate of 0.2° C./second or less for 100 seconds or longer. Thus, the precipitation of pro-eutectoid ferrite crystal grains is promoted so that the pro-eutectoid ferrite area proportion A is (appropriately) ensured, and further the grains are evenly dispersed, thereby attaining the promotion of spherical cementite and a decrease in the coarse portion grain diameter in the pre-microstructure. The lower limit of the average cooling rate at this cooling is not particularly limited. This rate is preferably 0.01° C./second or more from the viewpoint of the productivity. The end temperature of this cooling, which is varied in accordance with the chemical component composition of the steel, the finish rolling temperature and the cooling conditions up to the end of the cooling, is about 660° C. or lower. In a cooling subsequent to this cooling, an ordinary cooling (average cooling rate: about 0.1 to 50° C./second), such as cooling with a gas or natural cooling, may be conducted.

Manufacturing Method 2:

If the finish rolling temperature when this manufacturing method 2 is adopted is higher than 1200° C., it is difficult to adjust the average grain diameter of the bcc-Fe crystal grains to 35 μm or less. If the finish rolling temperature is higher than 1200° C., the coarse portion grain diameter of the bcc-Fe crystal grains also exceeds 50 μm easily. However, if the finish rolling temperature is lower than 1050° C., it is difficult to set the average grain diameter of the bcc-Fe crystal grains to 15 μm or more. Thus, the temperature needs to be 1050° C. or higher.

After being subjected to the finish rolling at a temperature range as described above, the workpiece is once cooled into a temperature in the range of 700° C. or higher and lower than 800° C. at an average cooling rate of 10° C./second or more. If the average cooling rate at this time is low, it is difficult to set the average grain diameter of the bcc-Fe crystal grains to 35 μm or less, or set the course portion grain diameter to 50 μm or less. Thus, the average cooling rate needs to ensure a value of 10° C./second or more.

Thereafter, in order to ensure the pro-eutectoid ferrite area proportion A (appropriately) and further disperse the ferrite evenly to decrease the coarse portion grain diameter in the pre-microstructure, the workpiece is cooled at an average cooling ate of 0.2° C./second or lower for 100 seconds or more. According to the cooling at the average cooling ate of 0.2° C./second or lower for 100 seconds or more (cooling period), the pro-eutectoid ferrite area proportion A is (appropriately) ensured and further the ferrite is evenly dispersed to attain the promotion of the growth of spherical cementite and a decrease in the coarse portion grain diameter in the pre-microstructure. The lower limit of the average cooling rate in this cooling is not particularly limited. From the viewpoint of the productivity, the rate is preferably 0.01° C./second or more. The cooling period is indispensably 100 seconds or more, and preferably 400 seconds or more, more preferably 500 seconds or more. Considering the productivity, and restriction based on the facilities, the cooling period is preferably 2000 seconds or less (more preferably, 1800 seconds or less) since the cooling can be performed in such a realistic period.

When the finish rolling temperature is high (for example, about 1200° C.), it is preferred to cool the workpiece rapidly according to circumstances after the above-mentioned cooling in order to prevent the average grain diameter of the bcc-Fe crystal grains from exceeding 35 μm, and the coarse portion grain diameter of the bcc-Fe crystal grains from exceeding 50 μm. In this cooling, the average cooling rate needs to be at least 10° C./second. This average cooling rate is preferably 20° C./second or more, more preferably 30°

C./second or more. At this time, the upper limit of the average cooling rate is not particularly limited. Realistically, the range of the rate is 200° C./second or lower. If the cooling stop temperature at this time is lower than 580° C., the total area proportion of pro-eutectoid ferrite and pearlite may be lower than 90% by area. By contrast, if the temperature is higher than 660° C., the coarse portion grain diameter of the bcc-Fe crystal grains easily exceeds 50 μm. After the cooling, it is sufficient that the workpiece is cooled at an average cooling rate of 1° C./second or less for 20 seconds or more. In the cooling from the temperature range of 580° C. or higher and 660° C. or less, the workpiece may be kept at it is without cooling the workpiece positively.

After a steel for mechanical structure for cold working is manufactured as described above, this steel is subjected to an ordinary spheroidizing to yield a steel having a metallic microstructure wherein the average circular equivalent diameter of bcc-Fee crystal grains is from 15 to 35 μm, cementite inside the bcc-Fe crystal grains has an aspect ratio of 2.5 or less, and further a K value represented by the following equation (2) is $1.3\times10^{-2}$ or less:

$$K\ \text{value}=(N\times L)/E \quad (2)$$

wherein E: the average circular equivalent diameter (μm) of the bcc-Fe crystal grains; N: the number density (/μm$^2$) of cementite inside the bcc-Fe crystal grains; and L: the aspect ratio of cementite inside the bcc-Fe crystal grains.

About a microstructure factor for softening spheroidized steel, reports have been hitherto made about a technique for a decrease in the aspect ratio or the number density of cementite. For example, JP 2000-73137 A discloses that such a steel is deceased in deformation resistance by decreasing the aspect ratio of cementite.

This technique makes the steel soft by decreasing the number density of cementite in the entire material microstructure (=the number density of cementite on ferrite grain boundaries, and that of cementite inside ferrite grains), or the aspect ratio of cementite in the entire material microstructure. Being different from this technique, the present invention has made it evident that a large advantage for the softening is obtained by decreasing the number density of cementite inside ferrite grains (inside bcc-Fe crystal grains) rather than that of cementite on ferrite grain boundaries.

It has been hitherto known that increasing the ferrite grain diameter after spheroidization is effective for making steel soft. However, at the time of subjecting an ordinary steel to an ordinary spheroidizing, an attempt to increase the ferrite grain diameter after the spheroidizing makes it easy, instead of increasing the diameter, for regenerated pearlite or remaining pearlite to be present in the spheroidized steel. Thus, the aspect ratio of cementite in the ferrite grains increases, or the number of cementite inside the ferrite grains increases so that after the spheroidizing, the steel is not sufficiently softened. Conversely, on the supposition that after being spheroidized, a steel contains fine ferrite grains, there exists a technique of decreasing the aspect ratio of cementite or decreasing the number density of cementite. However, the technique is insufficient for the softening.

Being different from these techniques, the present invention has made it evident that before a steel is spheroidized, an appropriate control of its pre-microstructure (the grain diameter, the ferrite area proportion and others in the pre-microstructure) makes it attainable compatibly to make the ferrite grains after the spheroidizing coarse, and decrease the number of cementite in the ferrite grains and the aspect ratio of cementite inside the ferrite grains, so that after the spheroidizing, the steel is made lower in hardness and in hardness unevenness than steels in the prior art. When the K value represented by the equation (2) is $1.3\times10^{-2}$ or less, the advantageous effects of the softening and the lowering in the hardness unevenness are remarkably obtained.

About the ordinary spheroidizing referred to in the present invention, the following is conceived: a cooling treatment of cooling a steel slowly or keeping the steel at temperatures just below the Al transformation point thereof in order to cause the steel to be kept in a two-phase region (ferrite+austenite) to decompose lamellar pearlite and subsequently make cementite sphere. Such a spheroidizing makes it possible to give a spheroidized microstructure as described above.

Hereinafter, the present invention will be described by working examples thereof in more detail. However, the examples do not limit the invention. Modifications obtained by changing respective designs of the examples in accordance with the subject matters that have been described hereinbefore and will be described hereinafter are each included in the technical scope of the invention.

EXAMPLES

While individual producing conditions (the finish rolling temperature, the average cooling rates, the cooling stop temperatures, and the cooling periods: see Tables 2 and 4 described later) were varied, steel species having respective chemical component compositions shown in Table 1 described below were used to manufacture wire rods that were different from each other in pre-microstructure and had a diameter of 8.0 mm (Example 1) or a diameter of 17.0 mm (Example 2).

TABLE 1

| Steel | Chemical component composition * (% by mass) | | | | | | | | | | |
|---|---|---|---|---|---|---|---|---|---|---|---|
| species | C | Si | Mn | P | S | Al | N | Additional element(s) | $Ceq_1$ | Ae | $Ceq_2$ |
| A | 0.46 | 0.18 | 0.71 | 0.026 | 0.017 | 0.029 | 0.004 | — | 0.52 | 27.1 | 0.64 |
| B | 0.44 | 0.17 | 0.81 | 0.017 | 0.010 | 0.021 | 0.008 | Cr: 0.09, Mo: 0.09 | 0.51 | 28.1 | 0.64 |
| C | 0.52 | 0.19 | 0.78 | 0.006 | 0.014 | 0.042 | 0.003 | Nb: 0.08 | 0.59 | 20.3 | 0.71 |
| D | 0.53 | 0.29 | 0.85 | 0.015 | 0.008 | 0.012 | 0.008 | Ni: 0.21 | 0.61 | 18.4 | 0.76 |
| E | 0.34 | 0.24 | 0.71 | 0.023 | 0.009 | 0.025 | 0.011 | Ti: 0.05, B: 0.002 | 0.41 | 37.7 | 0.53 |
| F | 0.35 | 0.15 | 0.85 | 0.027 | 0.011 | 0.049 | 0.002 | V: 0.13 | 0.42 | 36.8 | 0.55 |
| G | 0.45 | 0.21 | 0.69 | 0.008 | 0.014 | 0.031 | 0.002 | Cr: 0.24 | 0.51 | 28.1 | 0.63 |
| H | 0.53 | 0.21 | 0.75 | 0.014 | 0.006 | 0.039 | 0.003 | Cu: 0.04, Ni: 0.09 | 0.60 | 19.4 | 0.72 |
| I | 0.54 | 0.28 | 0.72 | 0.010 | 0.004 | 0.043 | 0.004 | Mo: 0.18 | 0.61 | 18.4 | 0.74 |
| J | 0.37 | 0.07 | 0.68 | 0.016 | 0.011 | 0.042 | 0.007 | Ti: 0.05, B: 0.002 | 0.42 | 36.7 | 0.52 |
| K | 0.34 | 0.18 | 0.81 | 0.021 | 0.009 | 0.037 | 0.004 | B: 0.0007 | 0.41 | 37.7 | 0.54 |
| L | 0.41 | 0.17 | 0.82 | 0.013 | 0.007 | 0.022 | 0.005 | Cr: 1.1 | 0.48 | 30.1 | 0.61 |

* Remainder: inevitable impurities other than iron, and P, S and N

Microstructure Factor Measuring Method:

At the time of measuring microstructure factors (the microstructure, the average grain diameter of bcc-Fe crystal grains, and the coarse portion grain diameter of the bcc-Fe crystal grains) and the hardness after the spheroidizing for each of the resultant wire rods (rolled steels), the wire rod, and a laboratory test specimen of the rod were each embedded in a resin to make it possible to observe a longitudinal cross section thereof. When the radius of the wire rod was represented by D, the rod or specimen was measured at a D/4 position thereof.

Measurement of the Average Grain Diameter and the Coarse Portion Grain Diameter of the Bcc-Fe Crystal Grains in the Pre-Microstructure:

An EBSP analyzer and an FE-SEM (field emission scanning electron microscope) were used to measure the average grain diameter of the bcc-Fe crystal grains in the pre-microstructure, and the coarse portion grain diameter thereof. Under a condition that a boundary about which the misorientation (oblique angle) is more than 15° denotes a crystal grain boundary, a "crystal grain" was defined, and the average grain diameter of the bcc-Fe crystal grains was decided. At this time, the area for the measurement had a size of 400 μm×400 μm, and steps for the measurement had, between any two thereof, an interval of 0.7 μm. Any measured point about which the confidence index, which shows the reliability of any measured orientation, was less than 0.1, was deleted from subjects to be analyzed. On the basis of results of the analysis, the coarse portion grain diameter of the bcc-Fe crystal grains in the pre-microstructure was defined as the average of the largest and the second largest values (circular equivalent diameters).

Microstructure Observation:

In the measurement of the total area proportion of pearlite+pro-eutectoid ferrite (the proportion of P+F), and the pro-eutectoid ferrite area proportion A (F area proportion A), the wire rod was nital-etched to cause its microstructure to make its appearance. The microstructure was observed through an optical microscope. At 400 magnifications, 10 visual fields thereof were photographed. From the photographs, the total area proportion of pearlite+pro-eutectoid ferrite (the proportion of P+F), and the pro-eutectoid ferrite area proportion A (F area proportion A) were determined by image analysis. In the analysis of the phases, 100 points were selected at random from each of the photographs, and the phase at each of the points was discriminated. The number of the points where each of the phases (ferrite, pearlite, bainite, and others) was present was divided by the number of all the points to gain the fraction of the phase. In the microstructure analysis, a microstructure region the inside of which was white not to have any density difference was judged to be pro-eutectoid ferrite; a dark contrast region where portions having a density and portions having no density were dispersed to be mixed with each other, to be pearlite; and a region where white needle-form portions were mixed with other portions, to be bainite.

Measurement of the Hardness after the Spheroidizing:

About the measurement of the hardness after the spheroidizing, a Vickers hardness meter was used to measure 15 points of the wire rod under a load of 1 kg. The average (Hv) thereof was calculated. The standard deviation of the respective hardnesses of the 15 points was also gained. By a standard of the hardness at this time, the wire rod was judged to be accepted when the hardness according to the average value satisfied the following expression (3):

$$Hv<88.4\times Ceq_2+80.0 \quad (3)$$

wherein $Ceq_2$=[C]+0.2×[Si]+0.2×[Mn] wherein [C], [Si] and [Mn] represent the respective contents by percentage (% by mass) of C, Si and Mn.

As the judgment of the unevenness of the hardness, when the wire rod had a sample standard deviation (unbiassed sample standard deviation) was 5 or less (calculated from the 15 points according to a function (STDEV) of the EXCEl), the wire rod was judged to be accepted.

Example 1

Steel species A shown in Table 1 was used. A working formastor test machine in a laboratory was used to imitate the above-defined rolling step, and vary the finish rolling temperature (work finishing temperature) and cooling conditions (the average cooling rates and the cooling stop temperatures) as shown in Table 2 described below, thereby manufacturing samples different from each other in pre-microstructure. In item "Manufacturing conditions" in Table 2, "cooling 1" represents a cooling from the finish rolling temperature to a temperature in the range of 700° C. or higher and lower than 800° C.; "cooling 2", a cooling after the cooling 1; "cooling 3", a cooling after the cooling 2; and "cooling 4", a cooling after the cooling 3 (in the case of the manufacturing method 1, the "cooling 3" and the "cooling 4" were not performed). After the end of the conditions shown in Table 2, the samples were each cooled with gas (average cooling rate: 1-50° C./second) down to a temperature close to room temperature (25° C.).

TABLE 2

| | Manufacturing conditions | | | | | |
|---|---|---|---|---|---|---|
| | Finish | Cooling 1 | | Cooling 2 | | |
| Tests Nos. | rolling temperature (° C.) | Average cooling rate (° C./second) | Cooling stop temperature (° C.) | Average cooling rate (° C./second) | Cooling period (seconds) | Cooling stop temperature (° C.) |
| 1 | 1100 | 41 | 740 | 0.2 | 500 | 640 |
| 2 | 1050 | 30 | 700 | 0.2 | 275 | 645 |
| 3 | 1200 | 45 | 745 | 0.1 | 650 | 680 |
| 4 | 1150 | 30 | 730 | 0.1 | 500 | 680 |
| 5 | 1250 | 8 | 780 | 0.2 | 400 | 700 |
| 6 | 1000 | 40 | — | — | — | — |
| 7 | 1250 | 30 | 760 | 0.2 | 600 | 640 |
| 8 | 1150 | 40 | 685 | 0.2 | 225 | 640 |
| 9 | 1200 | 30 | 720 | 2 | 15 | 690 |
| 10 | 1100 | 30 | 740 | 0.5 | 120 | 680 |

TABLE 2-continued

| Tests Nos. | Manufacturing conditions | | | | |
|---|---|---|---|---|---|
| | Cooling 3 | | Cooling 4 | | |
| | Average cooling rate (° C./second) | Cooling stop temperature (° C.) | Average cooling rate (° C./second) | Cooling period (seconds) | Cooling stop temperature (° C.) |
| 1 | — | — | — | — | — |
| 2 | — | — | — | — | — |
| 3 | 30 | 620 | 0.25 | 80 | 600 |
| 4 | 25 | 650 | 0.15 | 200 | 620 |
| 5 | 20 | 680 | 0.15 | 267 | 640 |
| 6 | — | 620 | 0.2 | 100 | 600 |
| 7 | — | — | — | — | — |
| 8 | — | — | — | — | — |
| 9 | 20 | 650 | 0.5 | 60 | 620 |
| 10 | 35 | 550 | 2 | 50 | 450 |

In this case, each of the working formastor samples was formed to have a size of 8.0 mm in diameter×12.0 mm. After the end of the thermal treatment thereof, the sample was divided into two equal parts. One of the two was used as a sample for pre-microstructure examination while the other was used as a sample for spheroidizing. In the spheroidizing, the following thermal treatment was conducted: the sample was sealed into a vacuum, held (soaked) in an atmospheric furnace at 740° C. for 6 hours, and subsequently cooled to 710° C. at an average cooling rate of 10° C./hour; the sample was then kept for 2 hours; and then the sample was cooled to 660° C. at an average cooling rate of 10° C./hour, and naturally cooled.

About each of these samples, Table 3 described below shows measurement results of the total area proportion of pearlite+pro-eutectoid ferrite (P+F proportion), the average grain diameter of the bcc-Fe crystal grains (α average grain diameter), the pro-eutectoid ferrite area proportion A (F area proportion A) and the coarse portion grain diameter of the bcc-Fe crystal grains (α coarse portion grain diameter) in the pre-microstructure, and the hardness after the spheroidizing. The standard permissible level of the softening in the steel species A, in which the C content by percentage was 0.46%, was less than Hv 137 on the basis of the expression (3).

TABLE 3

| Tests Nos. | Pre-microstructure | | | | Ae | Hardness (Hv) after spheroidizing | Standard deviation of the hardness after spheroidizing |
|---|---|---|---|---|---|---|---|
| | Proportion (% by area) of P + F | α Average grain diameter (μm) | F area proportion A (% by area) | α Coarse portion grain diameter (μm) | | | |
| 1 | 100 | 19 | 35 | 34 | 27.1 | 126 | 4 |
| 2 | 100 | 16 | 33 | 39 | 27.1 | 131 | 4 |
| 3 | 100 | 24 | 34 | 47 | 27.1 | 131 | 3 |
| 4 | 100 | 30 | 35 | 45 | 27.1 | 130 | 4 |
| 5 | 100 | 37 | 23 | 61 | 27.1 | 139 | 6 |
| 6 | 100 | 10 | 7 | 24 | 27.1 | 138 | 3 |
| 7 | 100 | 28 | 34 | 58 | 27.1 | 133 | 8 |
| 8 | 100 | 24 | 25 | 52 | 27.1 | 135 | 7 |
| 9 | 100 | 20 | 9 | 41 | 27.1 | 138 | 5 |
| 10 | 75 | — | 5 | — | 27.1 | 143 | 4 |

| Tests Nos. | Evaluation | | | | |
|---|---|---|---|---|---|
| | Proportion of P + F | Pre-microstructure α Average grain diameter | Pre-microstructure F area proportion A (% by area) | Pre-microstructure α Coarse portion grain diameter | Total |
| 1 | ○ | ○ | ○ | ○ | ○ |
| 2 | ○ | ○ | ○ | ○ | ○ |
| 3 | ○ | ○ | ○ | ○ | ○ |
| 4 | ○ | ○ | ○ | ○ | ○ |
| 5 | ○ | X | X | X | X |
| 6 | ○ | X | X | ○ | X |
| 7 | ○ | ○ | ○ | X | X |
| 8 | ○ | ○ | X | X | X |
| 9 | ○ | ○ | X | ○ | X |
| 10 | X | — | X | — | X |

From these results, a consideration can be made as follows: Tests Nos. 1-4 are examples satisfying all the requirements specified by the present invention. It can be understood that the hardness after the spheroidizing is sufficiently low and the unevenness of the hardness can also be made small (the standard deviation can be made small).

By contrast, tests Nos. 5-10 are examples lacking one or more of the requirements specified in the present invention, and are poor in one or more of the properties. Specifically, test No. 5 is an example about which the finish rolling temperature is high, the average cooling rate in the cooling 1 is small and further the cooling stop temperature in the cooling 3 is high so that each of the average particle diameter of the bcc-Fe crystal grains (α average grain diameter) and the coarse portion grain diameter thereof (α coarse portion grain diameter) are large, and further, the pro-eutectoid ferrite area proportion A (F area proportion A) is low. The hardness after the spheroidizing is high and further the standard deviation thereof is also large.

Test No. 6 is an example about which the slow cooling to a temperature in the range of 700° C. or higher and lower than 800° C. (cooling 2) is not performed after the finish rolling (when compared with any example of the manufacturing method 2), so that the average particle diameter of the bcc-Fe crystal grains (α average grain diameter) is small, and the pro-eutectoid ferrite area proportion A (F area proportion A) is low. After the spheroidizing, the example keeps a high hardness as it is.

Test No. 7 is an example about which the finish rolling temperature is high (relatively to that in the manufacturing method 1), so that the coarse portion grain diameter of the bcc-Fe crystal grains (α coarse portion grain diameter) and the standard deviation thereof are large. Test No. 8 is an example about which the finish rolling temperature is high and the cooling stop temperature in the cooling 1 is low (relatively to those in the manufacturing method 1), so that the pro-eutectoid ferrite area proportion (F area proportion A) is low and further the coarse portion grain diameter of the bcc-Fe crystal grains (α coarse portion grain diameter) is large. After the spheroidizing, the standard deviation of the hardness is large.

Test No. 9 is an example about which in the "cooling 2", the average cooling rate is high and the cooling period is short so that the pro-eutectoid ferrite area proportion A is low. After the spheroidizing, the example keeps a high hardness as it is. Test No. 10 is an example about which in the "cooling 2", the average cooling rate is high and in the "cooling 3" the cooling step temperature is low, so that the total area proportion of pearlite and pro-eutectoid ferrite (P+F proportion) is made lower than 90% by area by the precipitation of bainite. The hardness after the spheroidizing is high.

Example 2

Steel species B-L shown in Table 1 described above were used. While manufacturing conditions (work finishing temperature, the average cooling rates and the cooling stop temperatures, and the cooling periods) were varied as shown in Table 4 described below, samples (wire rods having a diameter of 17 mm) different from each other in pre-microstructure were manufactured. In item "Manufacturing conditions" in Table 4, "cooling 1" to "cooling 4" were the same as in Example 1. At this time, each of the working formastor samples was formed to have a size of 17.0 mm in diameter×15.0 mm. After the end of the thermal treatment thereof, the sample was divided into two equal parts. One of the two was used as a sample for pre-microstructure examination while the other as a sample for spheroidizing. In the spheroidizing, the following thermal treatment was conducted: the sample was sealed into a vacuum, held (soaked) in an atmospheric furnace at 740° C. for 6 hours, and subsequently cooled to 710° C. at an average cooling rate of 10° C./hour; the sample was then kept for 2 hours; and then the sample was cooled to 660° C. at an average cooling rate of 10° C./hour, and naturally cooled.

TABLE 4

| | | Manufacturing conditions | | | | | |
|---|---|---|---|---|---|---|---|
| | | Finish | Cooling 1 | | Cooling 2 | | |
| Tests Nos. | Steel species | rolling temperature (° C.) | Average cooling rate (° C./second) | Cooling stop temperature (° C.) | Average cooling rate (° C./second) | Cooling period (seconds) | Cooling stop temperature (° C.) |
| 11 | B | 1050 | 15 | 710 | 0.2 | 350 | 640 |
| 12 | C | 1050 | 20 | 720 | 0.2 | 400 | 640 |
| 13 | D | 1050 | 20 | 720 | 0.15 | 500 | 645 |
| 14 | E | 1100 | 15 | 730 | 0.1 | 900 | 640 |
| 15 | F | 1000 | 15 | 725 | 0.1 | 850 | 640 |
| 16 | G | 1150 | 20 | 750 | 0.1 | 700 | 680 |
| 17 | H | 1200 | 25 | 740 | 0.1 | 600 | 680 |
| 18 | I | 1050 | 15 | 740 | 0.2 | 250 | 690 |
| 19 | J | 1150 | 25 | 780 | 0.15 | 600 | 690 |
| 20 | K | 1100 | 20 | 730 | 0.2 | 150 | 700 |
| 21 | B | 900 | 15 | 710 | 0.2 | 150 | 680 |
| 22 | C | 1200 | 20 | 850 | 0.15 | 1000 | 700 |
| 23 | D | 1150 | 20 | 730 | 0.2 | 50 | 720 |
| 24 | E | 1250 | 20 | 750 | 0.5 | 100 | 700 |
| 25 | F | 1000 | 15 | 750 | 0.2 | 300 | 690 |
| 26 | L | 1150 | 20 | 750 | 0.1 | 700 | 680 |

| | Manufacturing conditions | | | | |
|---|---|---|---|---|---|
| | Cooling 3 | | Cooling 4 | | |
| Tests Nos. | Average cooling rate (° C./second) | Cooling stop temperature (° C.) | Average cooling rate (° C./second) | Cooling period (seconds) | Cooling stop temperature ( ° C.) |
| 11 | — | — | — | — | — |
| 12 | — | — | — | — | — |
| 13 | — | — | — | — | — |
| 14 | — | — | — | — | — |

TABLE 4-continued

| | | | | | |
|---|---|---|---|---|---|
| 15 | — | — | — | — | — |
| 16 | 10 | 600 | 0.5 | 40 | 580 |
| 17 | 15 | 630 | 0.1 | 300 | 600 |
| 18 | 20 | 660 | 0.2 | 100 | 640 |
| 19 | 15 | 620 | Kept as it was | 50 | 620 |
| 20 | 20 | 650 | 0.2 | 100 | 630 |
| 21 | 20 | 620 | 0.4 | 50 | 600 |
| 22 | 20 | 650 | 0.5 | 80 | 610 |
| 23 | 20 | 620 | 0.5 | 40 | 600 |
| 24 | 1 | 660 | 0.2 | 250 | 610 |
| 25 | 10 | 570 | 0.5 | 40 | 550 |
| 26 | 10 | 600 | 0.5 | 40 | 580 |

The samples were each measured about the total area proportion of pearlite+pro-eutectoid ferrite (P+F proportion), the average grain diameter of the bcc-Fe crystal grains (α average grain diameter), the pro-eutectoid ferrite area proportion A (F area proportion A), and the coarse portion grain diameter of the bcc-Fe crystal grains (α coarse portion grain diameter) in the pre-microstructure before the spheroidizing, and was further measured about the hardness after the spheroidizing in the above-mentioned manner. About each of these samples, Table 5 described below shows measurement results of the total area proportion of pearlite+pro-eutectoid ferrite, the average grain diameter of the bcc-Fe crystal grains (α average grain diameter), the pro-eutectoid ferrite area proportion A (F area proportion A) and the coarse portion grain diameter of the bcc-Fe crystal grains (α coarse portion grain diameter) in the pre-microstructure, and the hardness after the spheroidizing. Table 5 simultaneously shows the value of the right-hand side of the expression (3) (hereinafter referred to as the "B value).

TABLE 5

| | Pre-microstructure | | | | | | |
|---|---|---|---|---|---|---|---|
| Tests Nos. | Proportion (% by area) of P + F | α Average grain diameter (μm) | F area proportion A (% by area) | α Coarse portion grain diameter (μm) | Ae | Hardness (Hv) after spheroidizing | B value |
| 11 | 100 | 16 | 31 | 33 | 28.1 | 133 | 137 |
| 12 | 100 | 17 | 25 | 35 | 20.3 | 138 | 143 |
| 13 | 100 | 18 | 23 | 35 | 18.4 | 142 | 147 |
| 14 | 100 | 21 | 43 | 42 | 37.7 | 122 | 127 |
| 15 | 100 | 16 | 42 | 40 | 36.8 | 125 | 129 |
| 16 | 100 | 17 | 33 | 37 | 28.1 | 131 | 136 |
| 17 | 100 | 29 | 24 | 46 | 19.4 | 138 | 144 |
| 18 | 100 | 20 | 23 | 45 | 18.4 | 140 | 145 |
| 19 | 100 | 19 | 42 | 39 | 36.7 | 122 | 126 |
| 20 | 100 | 23 | 39 | 45 | 37.7 | 123 | 128 |
| 21 | 100 | 12 | 31 | 26 | 28.1 | 142 | 137 |
| 22 | 100 | 33 | 19 | 62 | 20.3 | 146 | 143 |
| 23 | 100 | 16 | 9 | 31 | 18.4 | 150 | 147 |
| 24 | 100 | 34 | 33 | 53 | 37.7 | 131 | 127 |
| 25 | 100 | 12 | 38 | 30 | 36.8 | 132 | 129 |
| 26 | 100 | — | 25 | — | 30.1 | 140 | 134 |

| | | Evaluation | | | | |
|---|---|---|---|---|---|---|
| Tests Nos. | Standard deviation of the hardness after spheroidizing | Proportion of P + F | Pre-microstructure α Average grain diameter | Pre-microstructure F area proportion A | Pre-microstructure α Coarse portion grain diameter | Total |
| 11 | 3 | ○ | ○ | ○ | ○ | ○ |
| 12 | 3 | ○ | ○ | ○ | ○ | ○ |
| 13 | 3 | ○ | ○ | ○ | ○ | ○ |
| 14 | 4 | ○ | ○ | ○ | ○ | ○ |
| 15 | 3 | ○ | ○ | ○ | ○ | ○ |
| 16 | 3 | ○ | ○ | ○ | ○ | ○ |
| 17 | 4 | ○ | ○ | ○ | ○ | ○ |
| 18 | 4 | ○ | ○ | ○ | ○ | ○ |
| 19 | 3 | ○ | ○ | ○ | ○ | ○ |
| 20 | 4 | ○ | ○ | ○ | ○ | ○ |
| 21 | 3 | ○ | X | ○ | ○ | X |
| 22 | 7 | ○ | ○ | X | X | X |
| 23 | 4 | ○ | ○ | X | ○ | X |
| 24 | 6 | ○ | ○ | X | X | X |
| 25 | 4 | ○ | X | ○ | ○ | X |
| 26 | 4 | X | — | X | — | X |

From these results, a consideration can be made as follows: Tests Nos. 11-20 are examples satisfying all the requirements specified by the present invention. It can be understood that the hardness after the spheroidizing is sufficiently low and the unevenness of the hardness can also be made small.

By contrast, tests Nos. 21-26 are examples lacking one or more of the requirements specified in the present invention, and are poor in one or more of the properties. Specifically, test No. 21 is an example about which the finish rolling temperature is low so that the average particle diameter of the bcc-Fe crystal grains (α average grain diameter) is small and the hardness after the spheroidizing is high. Test No. 22 is an example about which in the "cooling 1" the cooling step temperature is high (relatively to that in the manufacturing method 2), so that the pro-eutectoid ferrite area proportion A (F area proportion A) is low and further the coarse portion grain diameter of the bcc-Fe crystal grains (α coarse portion grain diameter) is large. The hardness after the spheroidizing is high and further the standard deviation thereof is also large.

Test No. 23 is an example about which the cooling period is short in the "cooling 2", so that the pro-eutectoid ferrite area proportion (F area proportion A) is low and the hardness after the spheroidizing is high. Test No. 24 is an example about which the finish rolling temperature is high, the average cooling rate in the "cooling 2" is high, and the average cooling rate in the "cooling 3" is low (relatively to those in the manufacturing method 2), so that the pro-eutectoid ferrite area proportion (F area proportion A) is low and further the coarse portion grain diameter of the bcc-Fe crystal grains (a coarse portion grain diameter) is large. The hardness after the spheroidizing is high and further the standard deviation thereof is also large.

Test No. 25 is an example about which the average cooling rate in the "cooling 3" is low and the average grain diameter of the bcc-Fe crystal grains (α average grain diameter) is small, so that the hardness after the spheroidizing is high. Test No. 26 is an example about which the steel species L, in which the Cr content by percentage is large, is used. Although appropriate manufacturing conditions are adopted therein, the pro-eutectoid ferrite area proportion (F area proportion A) is low and further the total area proportion of pearlite and pro-eutectoid ferrite (P+F proportion) is made smaller than 90% by area by the precipitation of martensite. Furthermore, the hardness after the spheroidizing is high.

Example 3

Samples of tests as shown in Table 6 described below, out of tests Nos. 1-26 described above, were newly manufactured, and then spheroidized. In the spheroidizing at this time, the following thermal treatment was conducted: each of the samples was sealed into a vacuum, held (soaked) in an atmospheric furnace at 740° C. for 4 hours, and subsequently cooled to 720° C. at an average cooling rate of 10° C./hour; the sample was then cooled to 710° C. at an average cooling rate of 2.5° C./hour; and then the sample was cooled to 660° C. at an average cooling rate of 10° C./hour, and naturally cooled. Test Nos. shown in Table 6 correspond to the test Nos. shown about Examples 1 and 2 (manufacturing conditions before the spheroidizing, and others are the same as described above).

The samples were each measured after the spheroidizing about the average grain diameter of the bcc-Fe crystal grains (α average grain diameter), the aspect ratio of cementite inside the bcc-Fe crystal grains, and the number density of cementite inside the bcc-Fe crystal grains, and the K value, and further measured about the hardness after the spheroidizing in the above-mentioned manners.

Measurement of the Aspect Ratio of Cementite Inside the Bcc-Fe Crystal Grains, and the Number Density of Cementite Inside the Bcc-Fe Crystal Grains:

For each of the test specimens (samples) subjected to the spheroidizing, metal microstructure factors thereof were measured in manners described hereinafter. The test specimen after the spheroidizing was embedded in a resin, and then a cut plane thereof was mirror-polished with/by emery paper, a diamond buff, and electrolytic polishing. Subsequently, the workpiece was etched with nital, and then an FE-SEM (field emission scanning electron microscope) was used to observe the mirror-finished plane of the test specimen and take photographic images thereof. The observation magnifying power was set in the range from 2000 to 4000 in accordance with the phase size. Arbitrarily-selected ten sites of the specimen were observed, and the microstructure at each of the observed sites was photographed.

An example of the microstructure is shown in FIG. 1 (an electron microscopic photograph thereof (instead of any drawing thereof). From such a microstructure, cementite contacting any boundary of bcc-Fe crystal grains was deleted (painted over with black) by image processing in order to measure cementite inside the bcc-Fe crystal grains. Cementite extending, along the longitudinal direction thereof, into one of the grains even when contacting the boundary of the bcc-Fe crystal grains was counted as cementite inside the grains. A standard for the judgment thereof was decided as follows: cementite about which the angle made between the major diameter of cementite and the tangent line of its grain boundary is 20° or more and the major diameter is 3 μm or more is regarded as being present inside the grain even when the grain contacts the grain boundary. The images, which were subjected to the processing, were used to measure the aspect ratio of cementite inside the bcc-Fe crystal grains, and the number density of cementite inside the bcc-Fe crystal grains by means of an image analyzing machine (Image-Pro Plus, manufactured by Media Cybernetics, Inc.)

Measurement of the Average Grain Diameter of the Fe Crystal Grains (α Average Grain Diameter):

An EBSP analyzer and an FE-SEM (field emission scanning electron microscope) were used to measure the specimen about the average grain diameter of the bcc-Fe crystal grains after the spheroidizing. Under a condition that a boundary about which the crystal misorientation (oblique angle) is more than 15° (high angle grain boundary) denotes a crystal grain boundary, a "crystal grain" was defined, and the average grain diameter of the bcc-Fe crystal grains (α average grain diameter) was decided. At this time, the area for the measurement had a size of 400 μm×400 μm, and steps for the measurement had, between any two thereof, an interval of 0.7 μm. Any measured points about which the confidence index, which shows the reliability of any measured orientation, was less than 0.1, was deleted from subjects to be analyzed.

The measurement results are shown in Table 6 described below.

TABLE 6

| Tests Nos. | Steel species | α Average grain diameter (μm) | Aspect ratio (—) | Number density (/μm$^2$) of cementite | K value (×10$^{-2}$) | Hardness (Hv) after spheroidizing | B value | Standard deviation of the hardness after spheroidizing |
|---|---|---|---|---|---|---|---|---|
| 1 | A | 20 | 2.2 | 0.094 | 1.0 | 126 | 137 | 4 |
| 2 | A | 17 | 2.1 | 0.096 | 1.2 | 131 | 137 | 3 |
| 3 | A | 23 | 2.3 | 0.111 | 1.1 | 131 | 137 | 4 |
| 11 | B | 17 | 2.0 | 0.098 | 1.1 | 133 | 137 | 3 |
| 12 | C | 16 | 2.2 | 0.089 | 1.2 | 138 | 143 | 3 |
| 14 | E | 22 | 2.1 | 0.109 | 1.0 | 122 | 127 | 3 |
| 17 | H | 28 | 2.2 | 0.160 | 1.3 | 138 | 144 | 4 |
| 18 | I | 20 | 2.1 | 0.113 | 1.2 | 139 | 145 | 3 |
| 19 | J | 21 | 2.0 | 0.109 | 1.0 | 123 | 126 | 3 |
| 20 | K | 24 | 2.3 | 0.097 | 0.9 | 122 | 128 | 4 |
| 5 | A | 38 | 3.9 | 0.123 | 1.3 | 141 | 137 | 7 |
| 7 | A | 29 | 3.2 | 0.134 | 1.5 | 136 | 137 | 7 |
| 21 | B | 12 | 2.2 | 0.085 | 1.6 | 142 | 137 | 5 |
| 22 | C | 31 | 2.6 | 0.208 | 1.7 | 147 | 143 | 7 |
| 23 | D | 17 | 2.4 | 0.129 | 1.8 | 149 | 147 | 5 |
| 24 | E | 35 | 3.1 | 0.163 | 1.4 | 130 | 127 | 6 |
| 25 | F | 12 | 2.3 | 0.077 | 1.5 | 131 | 129 | 5 |

From Table 6, a consideration can be made as follows: Tests Nos. 1-3, 11, 12, 14 and 17-20 are examples satisfying all the requirements specified by the present invention. It can be understood that the α grain diameter after the spheroidizing is small, the aspect ratio of cementite is also small and the hardness after the spheroidizing is sufficiently low, and further the unevenness of the hardness after the spheroidizing can also be made small.

By contrast, tests Nos. 5, 7 and 21-25 are examples lacking one or more of the requirements specified in the present invention, and show, after the spheroidizing, tendencies as described in the following: According to test No. 5, a sample is spheroidized in which the pre-microstructure α average grain diameter and the pre-microstructure α coarse portion grain diameter are large, and further also the pre-microstructure F area proportion is small; as a result, the α average grain diameter after the spheroidizing is large, the aspect ratio of cementite is large, the hardness after the spheroidizing is high and further the standard deviation of the hardness after the spheroidizing is also large.

According to test No. 7, a sample is spheroidized in which the pre-microstructure α coarse portion grain diameter is large; as a result, test No. 7 is an example in which the aspect ratio of cementite is large after the spheroidizing, and further the K value is large. The standard deviation of the hardness after the spheroidizing is large. According to each of tests Nos. 21 and 25, a sample is spheroidized in which the pre-microstructure α average grain diameter is small; as a result, tests Nos. 21 and 25 are each an example in which the α average grain diameter after the spheroidizing is small and further the K value is large. The hardness after the spheroidizing is high.

According to each of tests Nos. 22 and 24, a sample is spheroidized in which the pre-microstructure F area proportion is small and further the pre-microstructure α coarse portion grain diameter is large; as a result, the test is an example in which the aspect of cementite after the spheroidizing is large and further the K value is large. The hardness after the spheroidizing is high and further the standard deviation of the hardness is also large. According to test No. 23, a sample is spheroidized in which the pre-microstructure F area proportion is small; as a result, test No. 23 is an example in which the K value after the spheroidizing is large. The hardness after the spheroidizing is high.

The above has described embodiments of the present invention. However, the invention is not limited to the above-mentioned examples. Thus, it is allowable to modify the embodiments variously and carry out the modifications as far as the modifications do not depart from the subject matters recited in the claims.

The present application is based on Japanese Patent Application filed on Dec. 19, 2011 (Japanese Patent Application No. 2011-277683), and Japanese Patent Application filed on Mar. 26, 2012 (Japanese Patent Application No. 2012-070365), and contents therein are herein incorporated by reference.

INDUSTRIAL APPLICABILITY

In the present invention, its chemical component composition and further the total area proportion of pearlite and pro-eutectoid ferrite in its entire microstructure are specified, and the area proportion A of pro-eutectoid ferrite is caused to satisfy, about a relation with the value Ae represented by the predetermined relational expression, A>Ae. Additionally, the average circular equivalent diameter of the bcc-Fe crystal grains and the coarse grain diameter thereof are appropriately specified. These manners make it possible to realize a steel for mechanical structure for cold working which can be made sufficiently low in hardness even when the steel is subjected to an ordinary spheroidizing, and which can further be decreased in unevenness of hardness.

The invention claimed is:

1. A steel for mechanical structure for cold working, comprising:

C: 0.3 to 0.6% by mass,

Si: 0.005 to 0.5% by mass,

Mn: 0.2 to 1.5% by mass,

P: a positive amount of 0.03% or less by mass,

S: a positive amount of 0.03% or less by mass,

Al: 0.01 to 0.1% by mass,

N: a positive amount of 0.015% or less by mass, and iron, wherein the steel has a metallic microstructure comprising pearlite and pro-eutectoid ferrite, in a total area proportion of 90% or more based on area of the entire metallic microstructure;

area proportion A of the pro-eutectoid ferrite satisfies A>Ae, where Ae is calculated by equation (1):

$$Ae=(0.8-Ceq_1)\times 96.75 \quad (1)$$

wherein $Ceq_1$=[C]+0.1×[Si]+0.06×[Mn], wherein [C], [Si] and [Mn] represent the respective contents of C, Si and Mn by mass percentage; and bcc-Fe crystal grains each surrounded by a high angle grain boundary through which two crystal grains are adjacent to each other at a misorientation larger than 15° have an average circular equivalent diameter of 15 to 35 μm, and an average circular equivalent diameter of the largest and the second largest bcc-Fe crystal grains is 50 μm or less, where the bcc-Fe crystal grains contain crystal grains of the pro-eutectoid ferrite and ferrite contained in the pearlite.

2. The steel according to claim 1, further comprising, one or more elements selected from the group consisting of:

Cr: a positive amount of 0.5% or less by mass,

Cu: a positive amount of 0.25% or less by mass,

Ni: a positive amount of 0.25% or less by mass,

Mo: a positive amount of 0.25% or less by mass, and

B: a positive amount of 0.01% or less by mass.

3. The steel according to claim 2, further comprising, one or more elements selected from the group consisting of:

Ti: a positive amount of 0.2% or less by mass,

Nb: a positive amount of 0.2% or less by mass, and

V: a positive amount of 0.5% or less by mass.

4. The steel according to claim 1, further comprising, one or more elements selected from the group consisting of:

Ti: a positive amount of 0.2% or less by mass,

Nb: a positive amount of 0.2% or less by mass, and

V: a positive amount of 0.5% or less by mass.

5. The steel according to claim 1, wherein the total area proportion of pearlite and pro-eutectoid ferrite based on area of the entire metallic microstructure is 95% or more.

6. The steel according to claim 1, wherein the total area proportion of pearlite and pro-eutectoid ferrite based on area of the entire metallic microstructure is 97% or more.

7. The steel according to claim 1, wherein the total area proportion of pearlite and pro-eutectoid ferrite based on area of the entire metallic microstructure is 100%.

8. The steel according to claim 1, wherein the average circular equivalent diameter of the bcc-Fe crystal grains each surrounded by a high angle grain boundary through which two crystal grains are adjacent to each other at a misorientation larger than 15° is 18 to 32 μm.

9. The steel according to claim 1, wherein the average circular equivalent diameter of the bcc-Fe crystal grains each surrounded by a high angle grain boundary through which two crystal grains are adjacent to each other at a misorientation larger than 15° is 20 to 30 μm.

10. The steel according to claim 1, wherein the average circular equivalent diameter of the largest and the second largest bcc-Fe crystal grains is 45 μm or less.

11. The steel according to claim 1, wherein the average circular equivalent diameter of the largest and the second largest bcc-Fe crystal grains is 40 μm or less.

12. A steel for mechanical structure for cold working, comprising:

C: 0.3 to 0.6% by mass,

Si: 0.005 to 0.5% by mass,

Mn: 0.2 to 1.5% by mass,

P: a positive amount of 0.03% or less by mass,

S: a positive amount of 0.03% or less by mass,

Al: 0.01 to 0.1% by mass,

N: a positive amount of 0.015% or less by mass, and iron, wherein the steel has a metallic microstructure in which an average circular equivalent diameter of bcc-Fe crystal grains is from 15 to 35 μm, cementite inside the bcc-Fe crystal grains has an aspect ratio of 2.5 or less, and a K value calculated by equation (2) is $1.3\times10^{-2}$ or less:

$$K\ \text{value}=(N\times L)/E \quad (2)$$

wherein E is the average circular equivalent diameter of the bcc-Fe crystal grains by μm; N is number density of the cementite inside the bcc-Fe crystal grains per $\mu m^2$; and L is the aspect ratio of the cementite inside the bcc-Fe crystal grains.

13. A method for manufacturing the steel according to claim 1 the method comprising:

subjecting a working steel to finish rolling at a temperature higher than 950° C. and 1100° C. or lower to obtain a resultant steel, cooling the resultant steel to a temperature of 700° C. or higher and lower than 800° C. at an average cooling rate of 10° C./second or more, and subsequently cooling the resultant steel at an average cooling rate of 0.2° C./second or less for 100 seconds or more.

14. A method for manufacturing the steel according to claim 1, the method comprising:

subjecting a working steel to finish rolling at a temperature of 1050° C. or higher and 1200° C. or lower to obtain a resultant steel, cooling the resultant steel to a temperature of 700° C. or higher and lower than 800° C. at an average cooling rate of 10° C./second or more, subsequently cooling the resultant steel at an average cooling rate of 0.2° C./second or less for 100 seconds or more, subsequently cooling the resultant steel to a temperature ranging from 580 to 660° C. at an average cooling rate of 10° C./second or more, and subsequently cooling the resultant steel at an average cooling rate of 1° C./second or less for 20 seconds or more or keeping the resultant steel at the temperature of from 580 to 660° C.

* * * * *